US006557845B2

(12) United States Patent
Kaya et al.

(10) Patent No.: US 6,557,845 B2
(45) Date of Patent: May 6, 2003

(54) SHEET SEPARATING DEVICE

(75) Inventors: Mehmet Oktay Kaya, Lee, NH (US); Heiner Philipp Luxem, Durham, NH (US); Glenn Alan Guaraldi, Kingston, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 17 days.

(21) Appl. No.: 09/882,727

(22) Filed: Jun. 15, 2001

(65) Prior Publication Data

US 2002/0101026 A1 Aug. 1, 2002

Related U.S. Application Data

(60) Provisional application No. 60/265,377, filed on Jan. 31, 2001.

(51) Int. Cl.[7] ..... B65H 3/08

(52) U.S. Cl. ..... 271/90; 271/100; 271/107

(58) Field of Search ..... 271/90, 99, 100, 271/102, 106, 107; 221/211

(56) References Cited

U.S. PATENT DOCUMENTS

| | | | | | |
|---|---|---|---|---|---|
| 3,988,016 | A | | 10/1976 | Merker et al. | 270/55 |
| 4,728,092 | A | * | 3/1988 | Selak | 271/100 |
| 5,127,207 | A | * | 7/1992 | Cunningham | 271/102 |
| 5,174,560 | A | * | 12/1992 | Fujii | 271/107 |
| 5,219,432 | A | * | 6/1993 | Delbe et al. | 271/106 |
| 6,168,148 | B1 | | 1/2001 | Bechler et al. | 271/90 |
| 6,349,930 | B1 | * | 2/2002 | Kruger et al. | 271/106 |

* cited by examiner

*Primary Examiner*—John M. Jillions
(74) *Attorney, Agent, or Firm*—Davidson, Davidson &Kappel, LLC

(57) ABSTRACT

An apparatus for separating a flat product from a pile of flat products includes a sucker mechanism. The sucker mechanism has a sucker cup, a sucker tube and a vacuum device for generating a vacuum. The sucker tube has a first and second end, the sucker cup being coupled to the sucker tube at the first end of the sucker tube and the vacuum device being coupled to the sucker tube at the second end of the sucker tube. The second end of the sucker tube is movable arranged in the vacuum device so as to vary the sucker stroke of the sucker cup.

12 Claims, 6 Drawing Sheets

SHEET SEPARATING DEVICE

This is a non-provisional application claiming priority to Provisional Application No. 60/265,377 filed Jan. 31, 2001, which is hereby incorporated by reference herein.

BACKGROUND OF THE INVENTION

1. Field of the Invention

The present invention relates generally to apparatus for separating flat products from a pile of flat products, and particularly to an apparatus for separating flat products from a pile of flat products, the apparatus including a sucker mechanism having a movable sucker tube.

2. Background Information

In the technology of building books, including booklets, magazines, periodicals, and the like, the use of collating systems is well known. These systems typically have a transporting device on which individual flat products, such as signatures or sheets, are gathered to build a book-block set, which then is finished and bound. Typically, a number of feeders are arranged along the transporting device, each of the hoppers comprising a feeding mechanism for feeding an individual flat product from a pile of signatures onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a pile of flat products which is arranged in each hopper. The single flat products are drawn from the pile at its bottom end.

A sheet-separating device of this kind is described, for example, in U.S. Pat. No. 3,988,016. This document describes a high-speed paper inserting apparatus for insertion of supplements into newspapers. The inserts are placed to form a stack and a vacuum gripping member grips the lowermost insert from the stack and carries it to a pair of nip rollers which transport the insert to an opened newspaper. A single sheet requires a different sucker stroke than a 120 page or pre-inserted section. The different sucker motion requirements are due to the way the sheets or sections have to be positioned and controlled for proper singulation. Generally, the bottom of the stack of heavy sections is elevated to eliminate followers. This is accomplished by repositioning the lift hook and restrictors. When these adjustments are made the vacuum cup motion must be changed. To raise the sucker motion so that it properly engages the pile requires the sucker bar to stroke through a greater angle. In U.S. Pat. No. 6,168,148 an adjustable sucker mechanism having an upper and a lower part is coupled to a central lever. The central lever is rotatable about an axis extending through the central lever. The adjustment can be accomplished by moving the axis along the central lever.

SUMMARY OF THE INVENTION

The present invention provides an apparatus for separating flat products from a pile of flat products, the apparatus including a sucker mechanism including:

a sucker tube having a first and a second end;

at least one sucker cup coupled to the sucker tube at the first end of the sucker tube; and a vacuum device for providing a vacuum, the vacuum device being coupled to the sucker tube at the second end of the sucker tube;

wherein the second end of the sucker tube is movably received in the vacuum device so as to enable the at least one sucker cup to be variably positioned relative to the pile of flat products.

The sucker mechanism may be pivotable relative to the pile of flat products so as to enable the sucker cup to move to engage a bottommost flat product from the pile of flat products.

The vacuum device may define a bore therein, the second end of the sucker tube being slidably received in the bore.

The sucker mechanism may include a slide for positioning the sucker tube, the slide being coupled to the first end of the sucker tube and slidably disposed relative to the vacuum device.

The slide may be slidably disposed on-the vacuum device. A fixing device may be provided for holding the slide in a predetermined position. The fixing device may include a screw.

The vacuum device may include a vacuum inlet for generating a vacuum in the vacuum device.

A sucker bar may be provided, with the vacuum device being disposed on the sucker bar.

The sucker mechanism may also include:

a second sucker tube having a respective first and a second end;

a second sucker cup coupled to the second sucker tube at the respective first end of the second sucker tube; and a second vacuum device for providing a vacuum, the second vacuum device being coupled to the second sucker tube at the respective second end of the second sucker tube;

wherein the respective second end of the second sucker tube is movably disposed in the second vacuum device so as to enable the second sucker cup to be variably positioned relative to the pile of flat products independently of the sucker cup.

The sucker mechanism may include a slide for positioning the sucker tube and the second sucker tube, the slide being coupled to the first end of the sucker tube and the first end of the second sucker tube and slidably disposed relative to the vacuum device.

The slide may be slidably disposed on the vacuum device.

The present invention also provides a method for separating flat products from a pile of flat products, the method including:

providing a sucker mechanism including a sucker tube having a first and a second end, a sucker cup coupled to the sucker tube at the first end of the sucker tube, and a vacuum device for providing a vacuum, the vacuum device being coupled to the sucker tube at the second end of the sucker tube, the sucker tube being movably disposed in the vacuum device; and varying a position of the sucker cup relative to the pile of flat products by moving the sucker tube relative to the vacuum device.

The apparatus and method according to the present invention enable the sucker cups to be adjusted individually or in groups so as to adjust the respective sucker strokes to the type of flat product being separated from the pile in a feeder hopper.

BRIEF DESCRIPTION OF THE DRAWINGS

The present invention is elaborated upon below with reference to the accompanying drawings.

DETAILED DESCRIPTION

Figure 1:
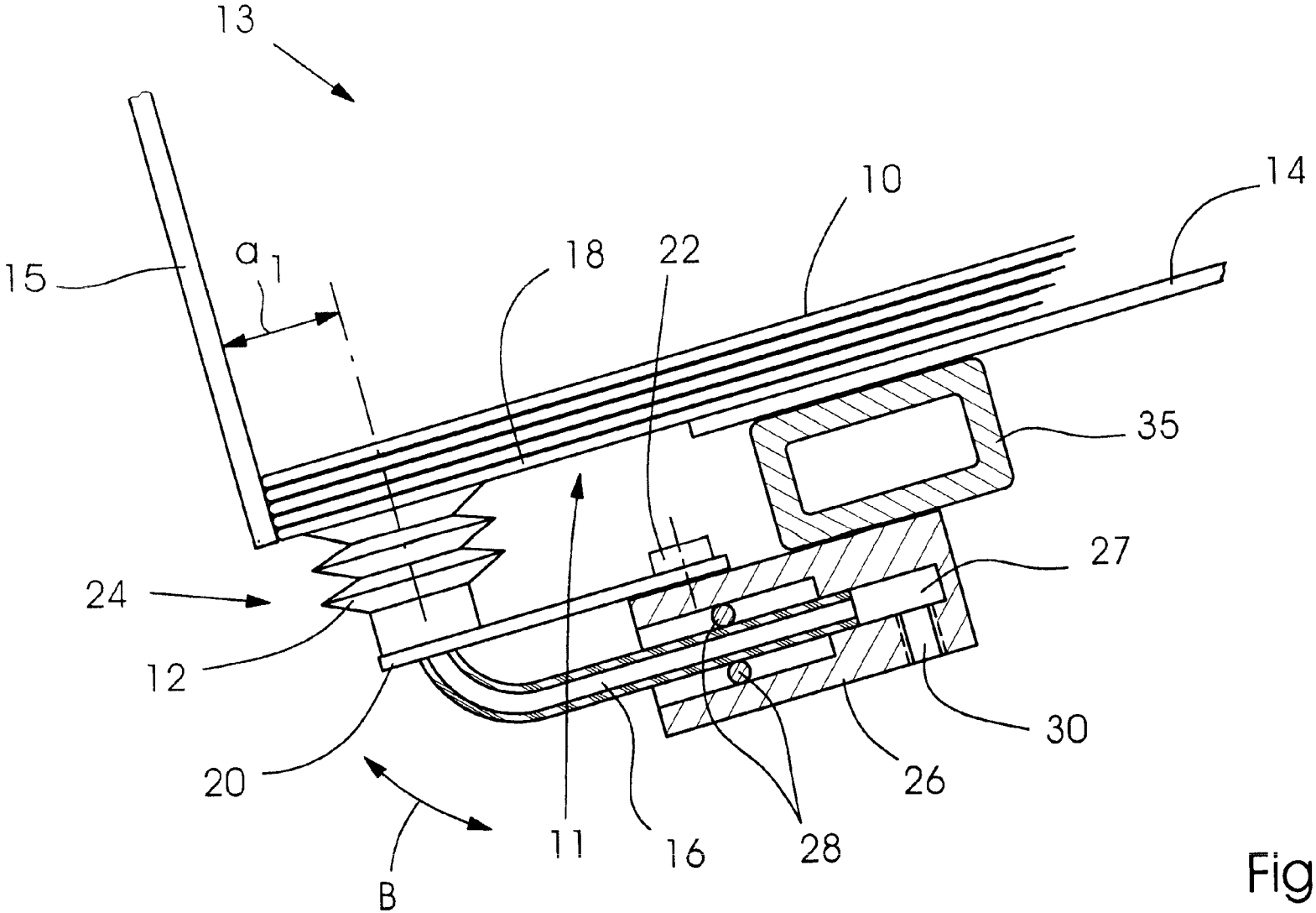
FIG. 1 shows a schematic side view of an apparatus according to the present invention in a first adjustment position.
Figure 3:
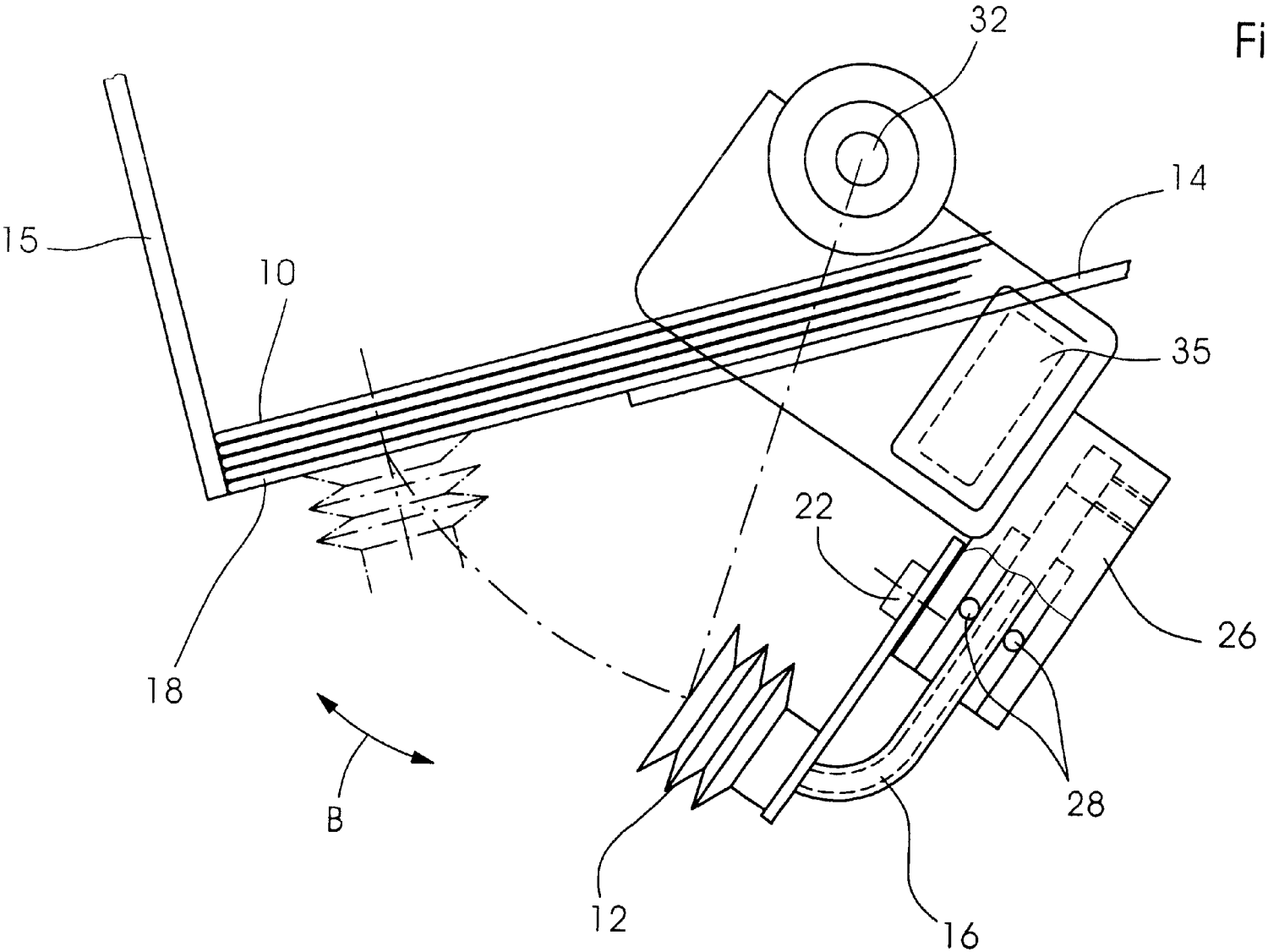
FIG. 3 shows an apparatus according to the present invention with the sucker in a rotated position.

Referring to FIG. 1 a schematic side view of a sheet-separating apparatus according to the present invention is shown. A pile of flat products 10, especially of sheets or signatures of paper or plastic, is arranged in hopper 13 and lays flat on a signature table 14 against front guide 15. One or more lift hooks and/or restrictors (not shown) may be provided to aid in supporting pile 10 and separating products from pile 10, as will be known to those of skill in the art. In order to be able to draw bottommost sheet 18 of pile 10, gap or recess 17 is provided at the bottommost end of the pile 10. For this purpose sucker 24 is pivotably mounted on a sucker pivot point 32 (FIG. 3) and can be rotated in the direction given by arrow B to move upwards and engage bottommost sheet 18, and then downward to remove bottommost sheet 18 from pile 10.

Figure 2:
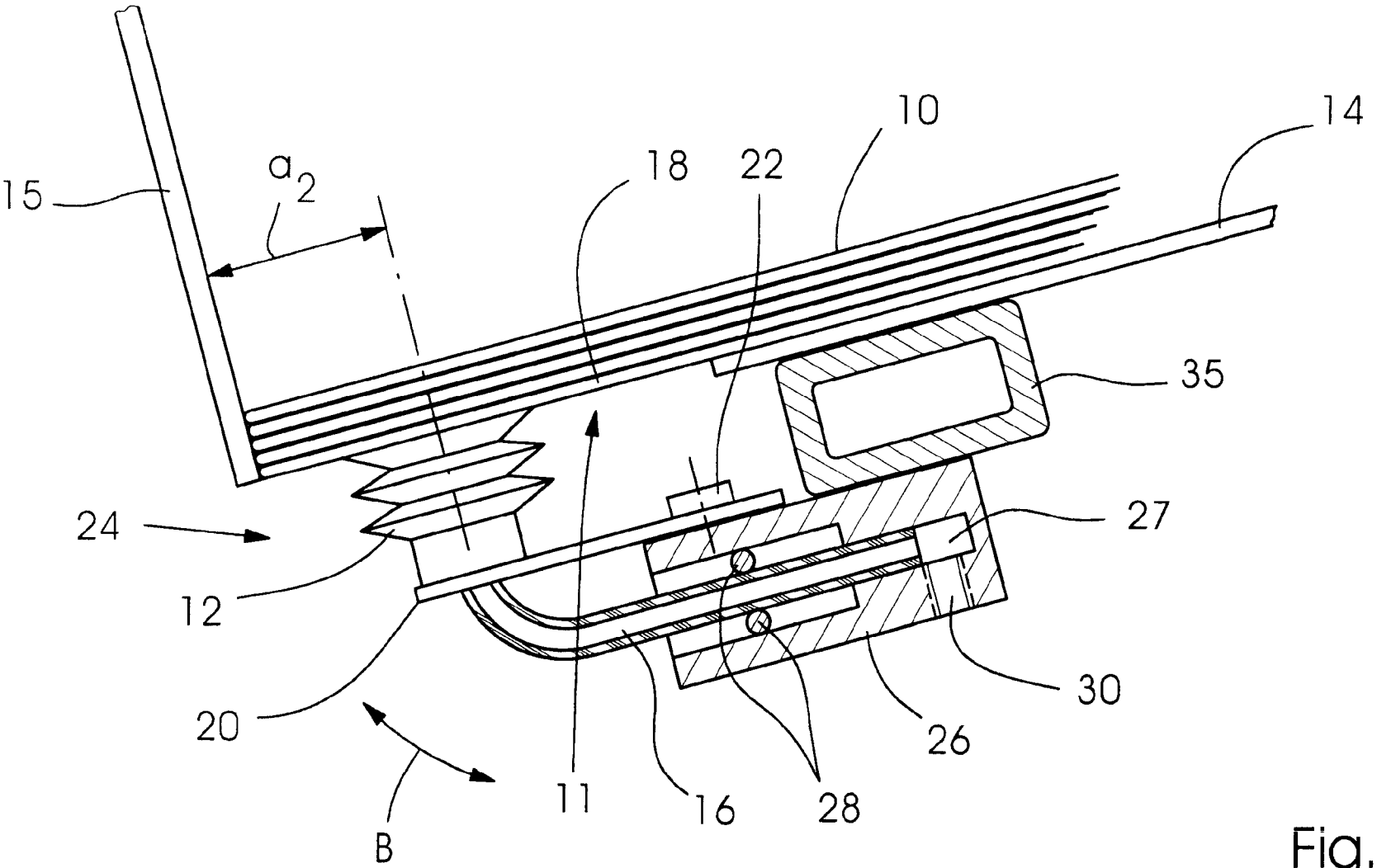
FIG. 2 shows a schematic side view of an apparatus according to the present invention in a second adjustment position.

Sucker 24 includes sucker cup 12 which is coupled to sucker tube 16 at a first end of sucker tube 16. Sucker tube 16 extends through slide 20. Slide 20 can be moved in horizontal direction by opening the fixing screw 22. By moving slide 20 it is possible to adjust the position of sucker cup 12, indicated in FIG. 1 by distance $a_1$, to another distance indicated in FIG. 2 by distance $a_2$. Sucker tube 16 is at its second end coupled to a vacuum device 26 and movably arranged in bore 27 of vacuum device 26 in order to allow the positioning of the sucker cup 12 when the slide 20 is moved so as to vary pivot radius r of the sucker cup relative to pivot 32. The position of sucker cup 12 may thereby be adjusted to provide a sucker stroke, or pivoting angle, adapted to the particular type of flat products in pile 10 and the corresponding lift hook and restrictor positions, for example.

Sealing device 28 is coupled to the sucker tube 16 within vacuum device 26 in a way which allows the sucker tube to move while still permitting a vacuum to be applied to the sucker tube. Vacuum inlet 30 is provided in vacuum device 26 to enable a vacuum to be drawn therein.

Sucker cup 12 may be a flexible cup-shaped member, or any member suitable for engaging bottommost sheet 18 using a vacuum suction. Sucker tube 16 can be a rigid tube of circular cross-section or any conduit suitable for connecting sucker cup 12 on one end to vacuum device 26 at its other end, while being movable relative to vacuum device 26 so as to vary the position of sucker cup 12. Slide 20 may be a thin, flat elongated member having an opening, for example, to permit sucker tube 16 to communicate with sucker cup 12. Alternatively, slide 20 may in other embodiments according to the present invention grip or hold sucker tube 16 and/or sucker cup 12 in a suitable manner. Slide 20 may define a slot for accommodating fixing screw 22 so as to permit slide 20 to translate relative to the fixing screw and thereby reposition sucker tube 16 and with it sucker cup 12. Fixing screw 22 may thread directly into vacuum device 26. Other configurations may be envisioned which permit sucker tube 16 and sucker cup 12 to be slidably repositioned and then fixed in place relative to vacuum device 26.

Vacuum device 26 is preferably a rigid body having a bore 27 formed therein. Bore 27 may be circular in cross-section, or any shape suitable for slidably receiving sucker tube 16 so as to transmit a suction via the sucker tube to sucker cup 12. Sealing device 28 serves to isolate the inside of vacuum device 26 from atmospheric pressure while still permitting sucker tube 16 to slide relative to vacuum device 26. Seal 28 may be a rubber o-ring or other suitable sealing member. Vacuum inlet 30 may be connected to a vacuum pump or any suitable system for drawing a vacuum in vacuum device 26. The vacuum may be drawn in vacuum device 26 continuously, or in timed intervals synchronized to the removing of sheets 18 from pile 10.

Figure 4:
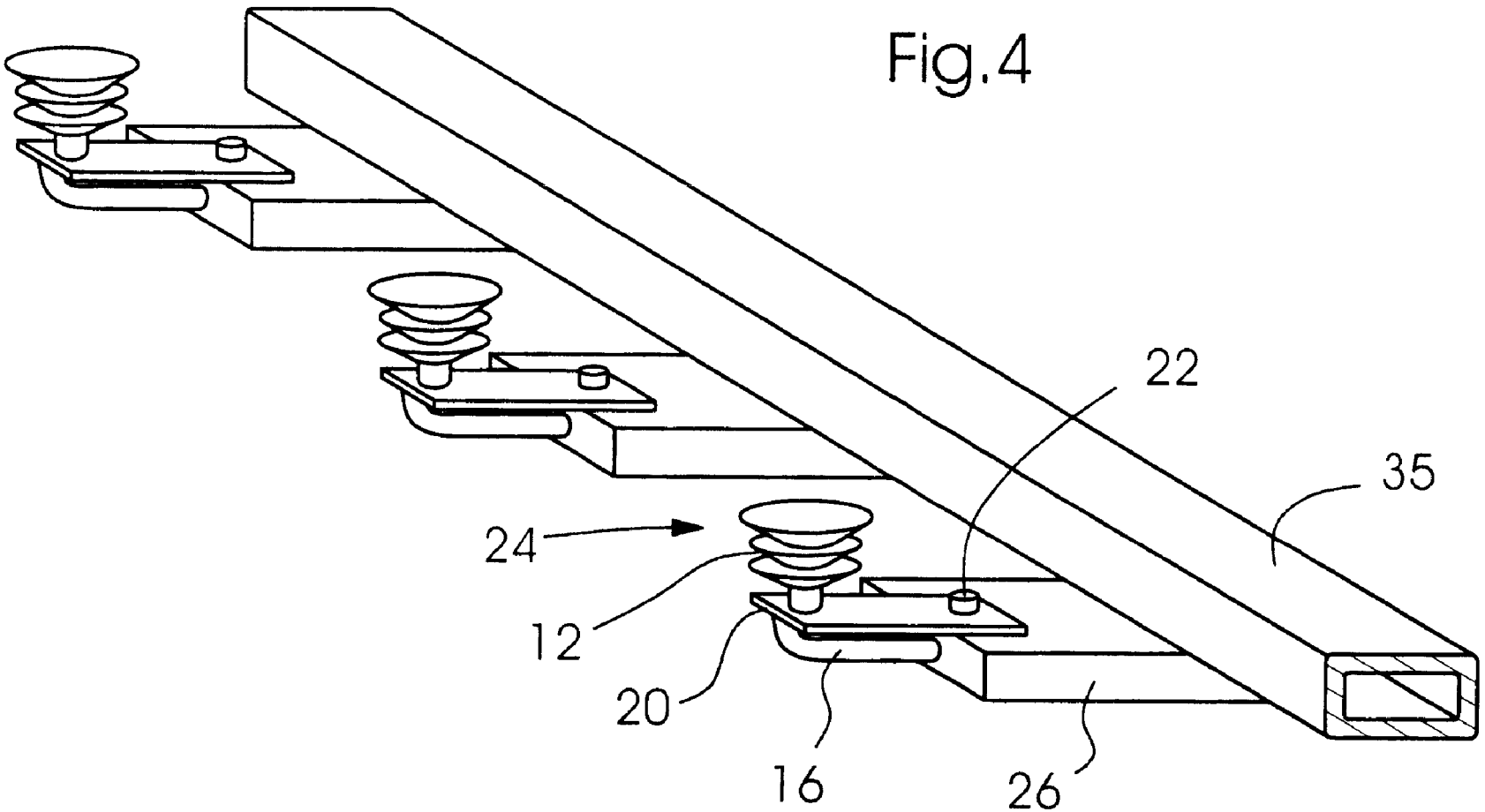
FIG. 4 shows a perspective view of an apparatus according to the present invention having a plurality of suckers.

Vacuum device 26 may be mounted on sucker bar 35, or in any of a variety of suitable configurations so that the vacuum device pivots to bring sucker cup 12 to bottommost sheet 18 of pile 10. A shown in FIG. 4, some embodiments according to the present invention may include a plurality of suckers 24, each with an associated vacuum device 26, sucker tube 16, sucker cup 12 and slide 20. The plurality of vacuum devices 26 may in such cases be mounted on sucker bar 35 so that all of the suckers pivot at pivot point 32 and move in unison to engage bottommost sheet 18. Each of the slides 20 may be independently adjusted so as to adjust the respective position of each sucker cup 12.

Figure 5:
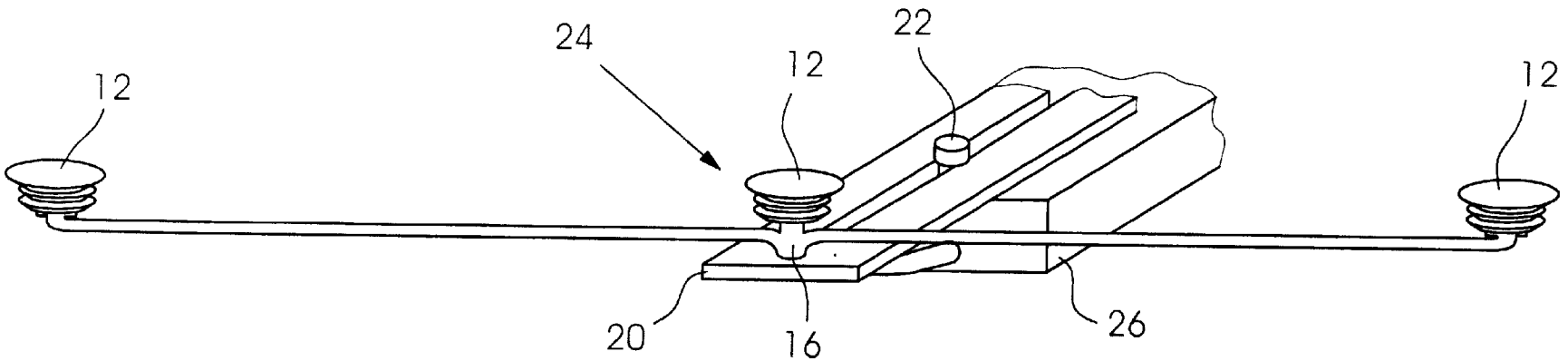
FIG. 5 shows a perspective view of an apparatus according to the present invention having a plurality of suckers coupled to one sucker tube.

Referring now to FIG. 5, in some embodiments according to the present invention more than one sucker cup 12 may be coupled to sucker tube 16. The position of all sucker cups 12 coupled to sucker tube 16 are adjusted at once by moving slide 20, as described above.

Figure 6:
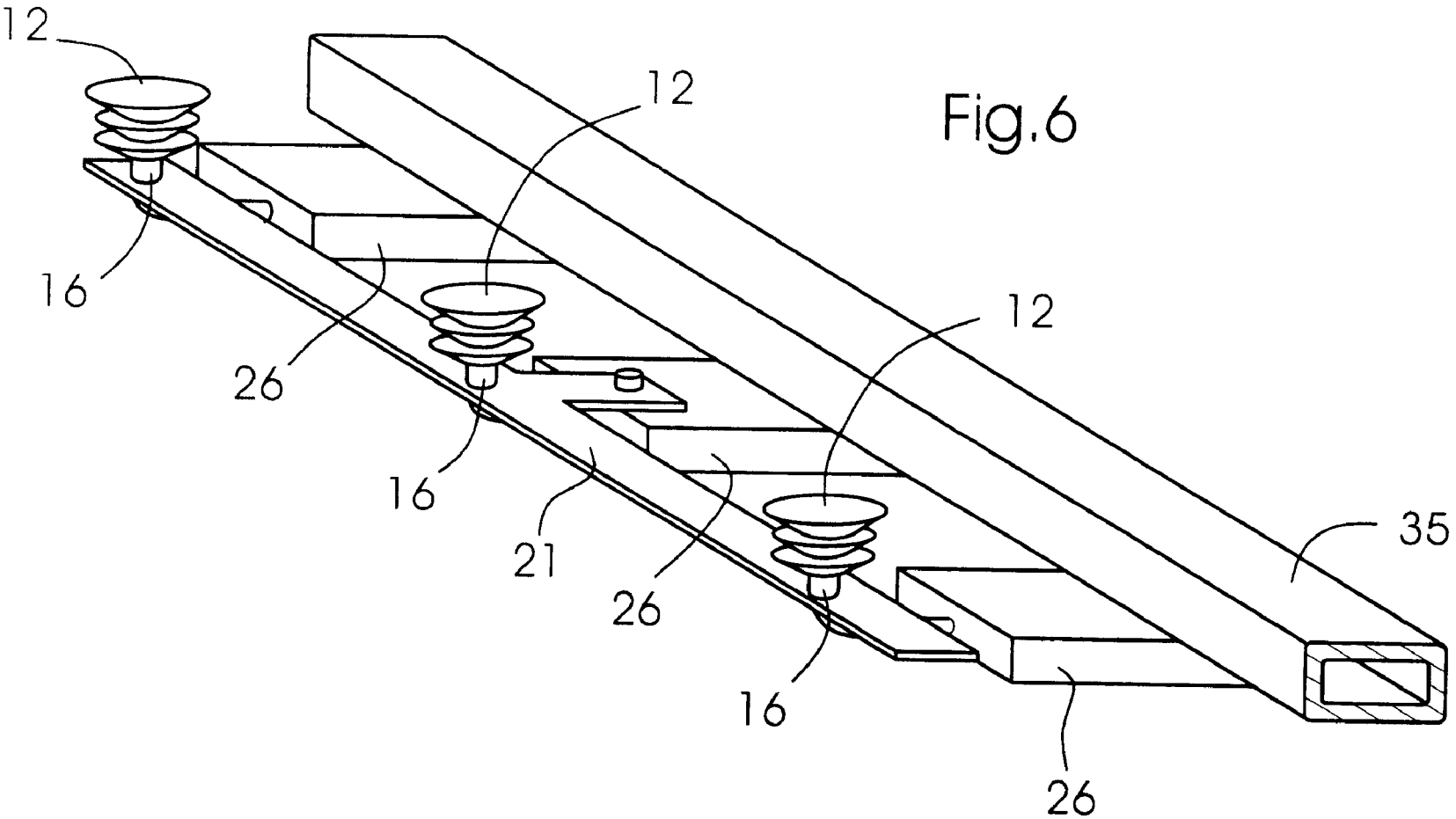
FIG. 6 shows a perspective view of an apparatus according to the present invention having a plurality of sucker tubes extending through one slide.

With reference to FIG. 6, in some embodiments according to the present invention, more than one sucker tube 16, each coupled to a respective sucker cup 12, may extend through slide 20. Slide 20 may accordingly include, for example, transverse extension 21 through which the sucker tubes 16 extend. In such embodiments, the position of all sucker cups 12 coupled to sucker tubes 16 are adjusted at once by moving slide 20. Each of sucker tubes 16 may be coupled to an associated vacuum device 26 of the type and in the manner as described above, for example. Additionally, in other embodiments of the present invention more than one sucker cup 12 may be coupled to each sucker tube 16 extending through a single slide 20.

It will of course be understood that the present invention has been described above only by way of example and that modifications of details can be made within the scope of the invention.

What is claimed is:

1. An apparatus for separating flat products from a pile of flat products, the apparatus comprising a sucker mechanism including:

a sucker tube having a first and a second end;

at least one sucker cup coupled to the sucker tube at the first end of the sucker tube; and a vacuum device for providing a vacuum, the vacuum device being coupled to the sucker tube at the second end of the sucker tube;

wherein the second end of the sucker tube is movably received in the vacuum device so as to enable the at least one sucker cup to be variably positioned relative to the pile of flat products; and wherein the sucker mechanism further includes a slide for positioning the sucker tube, the slide being coupled to the first end of the sucker tube and slidably disposed relative to the vacuum device.

2. The apparatus as recited in claim 1 wherein the slide is slidably disposed on the vacuum device.

3. The apparatus as recited in claim 1 wherein the sucker mechanism further includes a fixing device for holding the slide in a predetermined position.

4. The apparatus as recited in claim 3 wherein the fixing device includes a screw.

5. The apparatus as recited in claim 1 further comprising a sucker bar, the vacuum device being disposed on the sucker bar.

6. The apparatus as recited in claim 1 further comprising:

a second sucker tube having a respective first and a second end;

a second at least one sucker cup coupled to the second sucker tube at the respective first end of the second sucker tube; and a second vacuum device for providing a vacuum, the second vacuum device being coupled to the second sucker tube at the respective second end of the second sucker tube;

wherein the respective second end of the second sucker tube is movably disposed in the second vacuum device so as to enable the second at least one sucker cup to be variably positioned relative to the pile of flat products independently of the at least one sucker cup.

7. The apparatus as recited in claim 6 wherein the sucker mechanism further includes a slide for positioning the sucker tube and the second sucker tube, the slide being coupled to the first end of the sucker tube and the first end of the second sucker tube and slidably disposed relative to the vacuum device.

8. The apparatus as recited in claim 7 wherein the slide is slidably disposed on the vacuum device.

9. A method for separating flat products from a pile of flat products, the method comprising:

providing a sucker mechanism including a sucker tube having a first and a second end, at least one sucker cup coupled to the sucker tube at the first end of the sucker tube, and a vacuum device for providing a vacuum, the vacuum device being coupled to the sucker tube at the second end of the sucker tube, the sucker tube being movably disposed in the vacuum device; and varying a position of the at least one sucker cup relative to the pile of flat products by moving the sucker tube relative to the vacuum device;

wherein the moving the sucker tube relative to the vacuum device is performed using a slide for positioning the sucker tube, the slide being coupled to the first end of the sucker tube and slidably disposed relative to the vacuum device.

10. The method as recited in claim 9 wherein the slide is slidably disposed on the vacuum device.

11. The method as recited in claim 9 further comprising holding the slide in a predetermined position using a fixing device.

12. The method as recited in claim 9 further comprising:

providing a second sucker tube having a respective first and a second end, a second at least one sucker cup coupled to the second sucker tube at the respective first end of the second sucker tube, and a second vacuum device for providing a vacuum, the second vacuum device being coupled to the second sucker tube at the respective second end of the second sucker tube; and varying a position of the second at least one sucker cup relative to the pile of flat products by moving the second sucker tube relative to the second vacuum device.

* * * * *